US006341715B1

(12) United States Patent
Semenenko

(10) Patent No.: US 6,341,715 B1
(45) **Date of Patent: *Jan. 29, 2002**

(54) VALVE FOR THE FLOW CONTROL OF A FLUID COMPRISING SOLID PARTICLES

(75) Inventor: Ivan Semenenko, Moreton-in-Marsh (GB)

(73) Assignee: Matcon (R&D) Limited, Gloucestershire (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/011,259

(22) PCT Filed: Jul. 11, 1996

(86) PCT No.: PCT/GB96/01674

§ 371 Date: Jul. 16, 1998

§ 102(e) Date: Jul. 16, 1998

(87) PCT Pub. No.: WO97/06079

PCT Pub. Date: Feb. 20, 1997

(30) Foreign Application Priority Data

Aug. 4, 1995 (GB) ..... 9516027

(51) Int. Cl.[7] ..... B67B 7/00; G01F 11/00

(52) U.S. Cl. ..... 222/1; 222/185.1; 222/504; 222/509; 251/60

(58) Field of Search ..... 222/504, 1, 185.1, 222/559, 509; 251/60; 141/312, 346, 348, 349, 368, 387

(56) References Cited

U.S. PATENT DOCUMENTS

| | | | | | |
|---|---|---|---|---|---|
| 3,072,295 | A | * | 1/1963 | Lovette | 222/76 |
| 3,733,012 | A | * | 5/1973 | Grun | 222/193 |
| 3,939,729 | A | * | 2/1976 | Brockelsby | 74/575 |
| 4,120,409 | A | * | 10/1978 | Vander Werff | 222/504 |
| 4,691,843 | A | * | 9/1987 | Dunan | 222/58 |
| 4,893,735 | A | * | 1/1990 | Lonardi | 222/168 |
| 5,582,332 | A | * | 12/1996 | Kiefer et al. | 222/504 |
| 5,727,607 | A | * | 3/1998 | Ichikawa et al. | 141/67 |

* cited by examiner

*Primary Examiner*—Timothy L. Maust
(74) *Attorney, Agent, or Firm*—Miles & Stockbridge P.C.

(57) ABSTRACT

Apparatus for operating a closure for an aperture of a material storage container has a device to regulate the position of the closure relative to the aperture, so that an annular gap through which material is discharged is adjustable to prevent crushing of material which might be "bridged" in the gap.

14 Claims, 5 Drawing Sheets

VALVE FOR THE FLOW CONTROL OF A FLUID COMPRISING SOLID PARTICLES

BACKGROUND OF THE INVENTION

The invention relates to apparatus for operating a closure, a material handling system including such apparatus, and a method of transferring a flowable material from a material storage container.

Material handling apparatus generally consists of a storage container or silo, with a discharge aperture, and operating means therefor. Product from the silo is discharged mainly due to gravity through the aperture which is generally located at or near the bottom of the apparatus. A problem experienced with apparatus such as this is that on delivery, brittle, or friable products such as for example, tablets, can be damaged. In particular, when the aperture is closed after an amount of product has been dispensed, product trapped between the closure and the rim of the aperture may be crushed, resulting in a loss of useable product, and potential contamination by dust.

BRIEF SUMMARY OF THE INVENTION

It is an object of the invention to mitigate problems such as this.

According to the invention there is provided apparatus for operating a closure for an aperture of a material storage container, comprising means to regulate the position of the closing relative to the aperture during closure thereof.

The regulating means may comprise moveable stop means adapted to abut a part of the apparatus when the closure is moved toward the closed position.

The regulating means may include adjustment means to adjust the position of the stop means relative to the closure.

The adjustment means may be operable to move the stop means from an operating to a non-operating position.

The stop means may be pivotably mounted for movement between the operating and non-operating positions.

The adjustment means may comprise cylinder means.

The stop means may comprise a tapering nose part, a surface of which is disposed to contact a part of the apparatus when the closure is moved toward the closed position.

The apparatus may comprise cylinder means for operating the closure.

It is preferred that the regulating means is adapted to cooperate with a part of the cylinder means for regulation of the position of the closure. The cylinder part may comprise an elongate extension, which moves with the cylinder means when it is operated.

According to a second aspect of the invention, there is provided a material handling system including a material storage container having an aperture and a closure therefor, comprising apparatus as hereinbefore defined. The apparatus is preferably disposed outside of the container and closure.

According to a third aspect of the invention there is provided a method of transferring a flowable product from a material storage container which comprises the steps of providing apparatus to open a closure of the container, allowing material to run out of the container and then operating the apparatus to move the closure toward a closed position to leave a gap between the closure and the container, so that material trapped between the closure and the container is not crushed.

BRIEF DESCRIPTION OF THE DRAWINGS

Apparatus embodying the invention is hereinafter described, by way of example, with reference to the accompanying drawings.

DETAILED DESCRIPTION OF THE INVENTION

Figure 1:
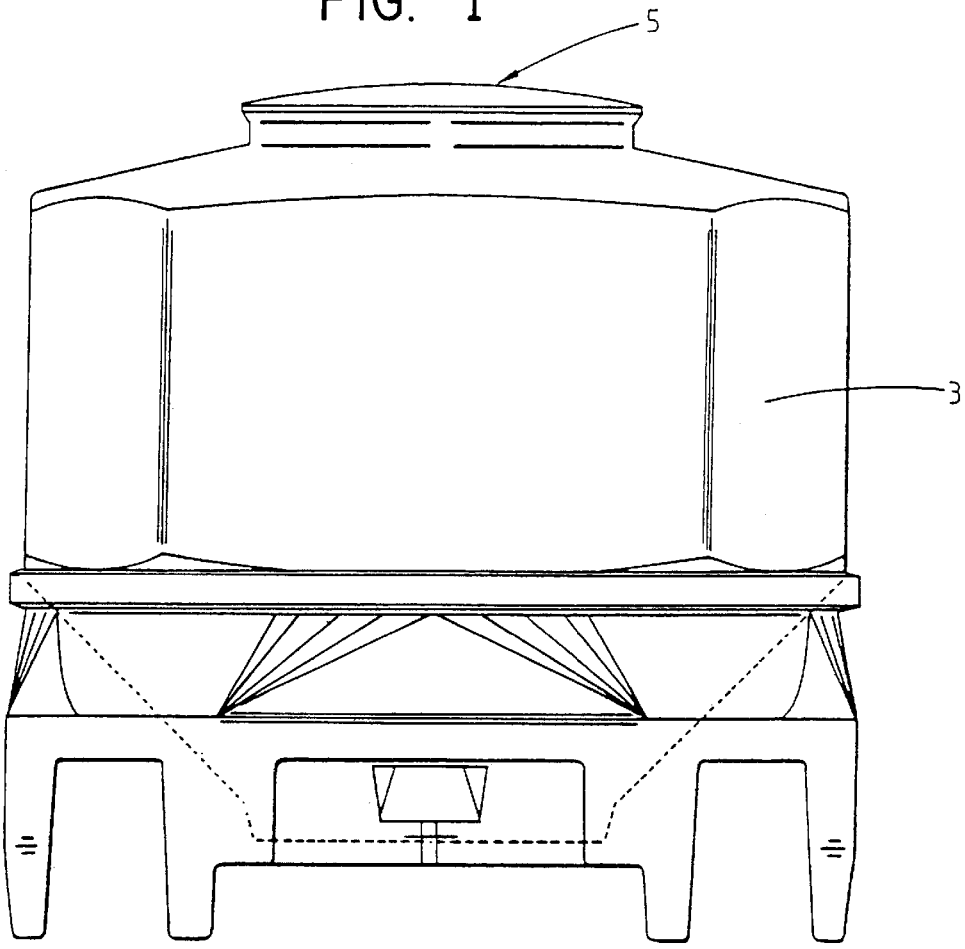
FIG. 1 is a side view of a material storage and discharge container for use with apparatus according to the invention.
Figure 2:
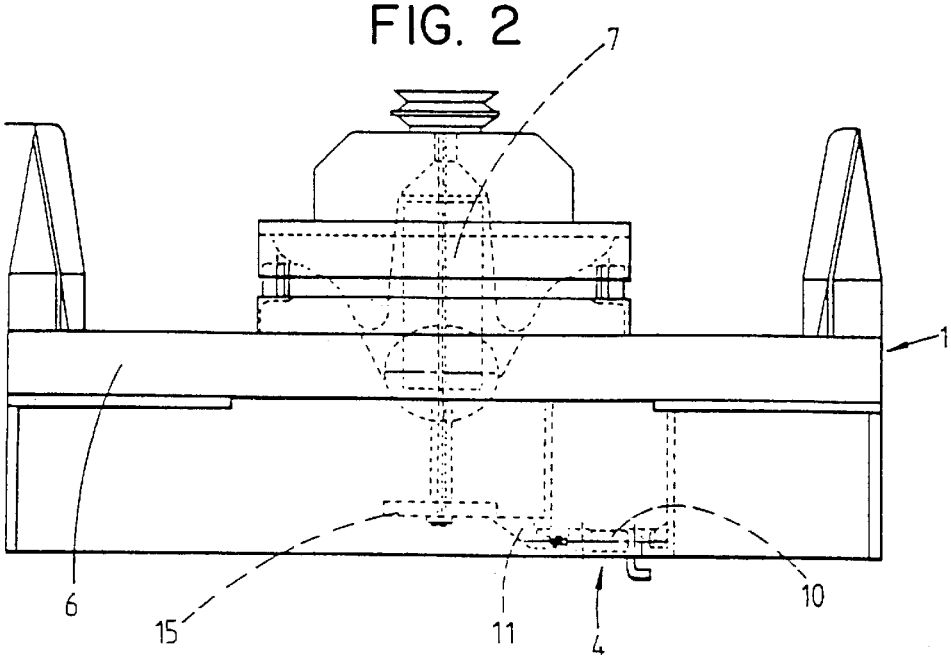
FIG. 2 is a side view of a base part including apparatus according to the invention.

Referring to the drawings, there is shown apparatus 1 for operating a closure 2 for an aperture of a material storage container 3, comprising means 4 to regulate the position of the closure 2 relative to the aperture.

Figure 3:
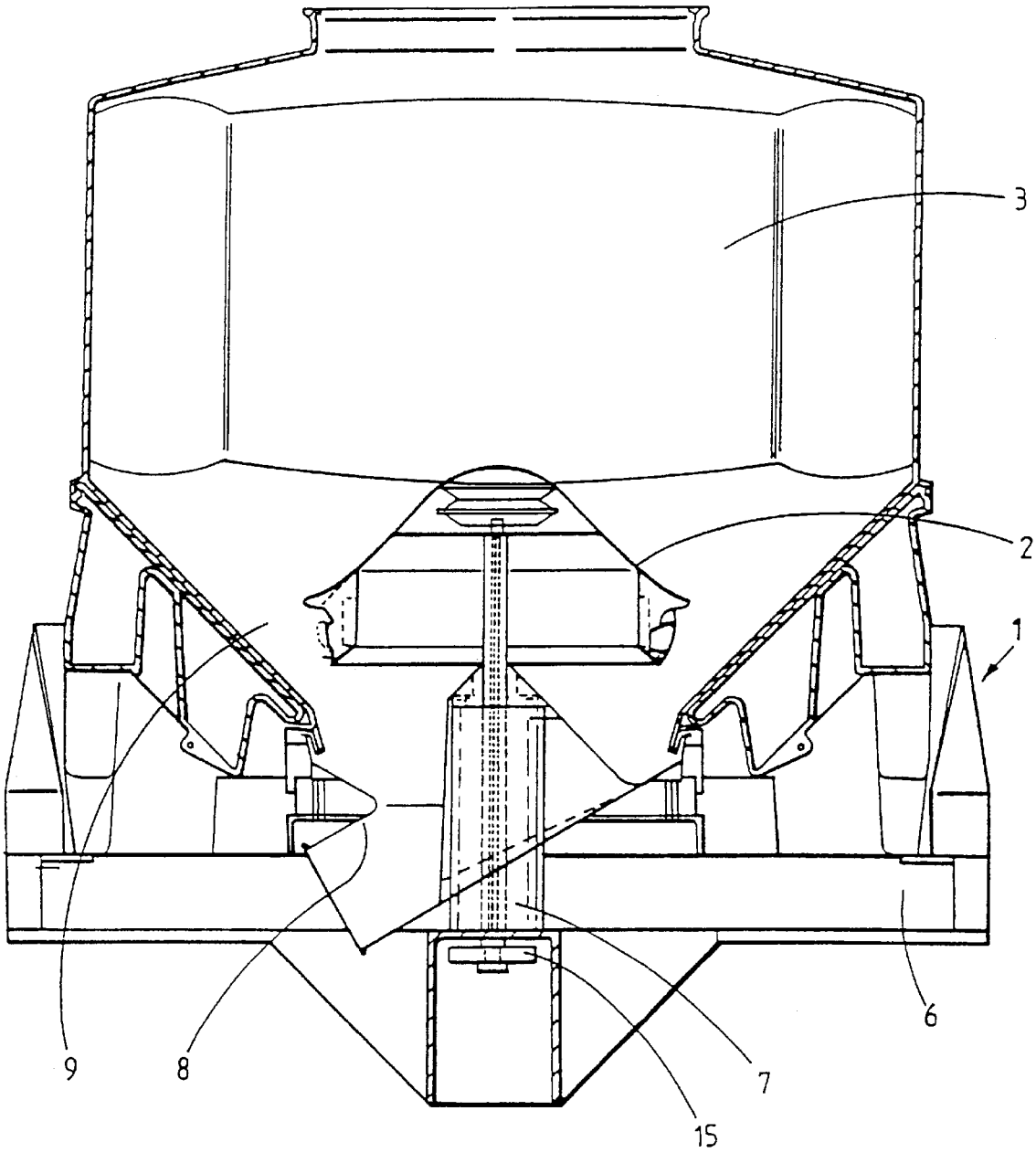
FIG. 3 is a side sectional view of the apparatus of FIGS. 1 and 2 in an open position.
Figure 4:
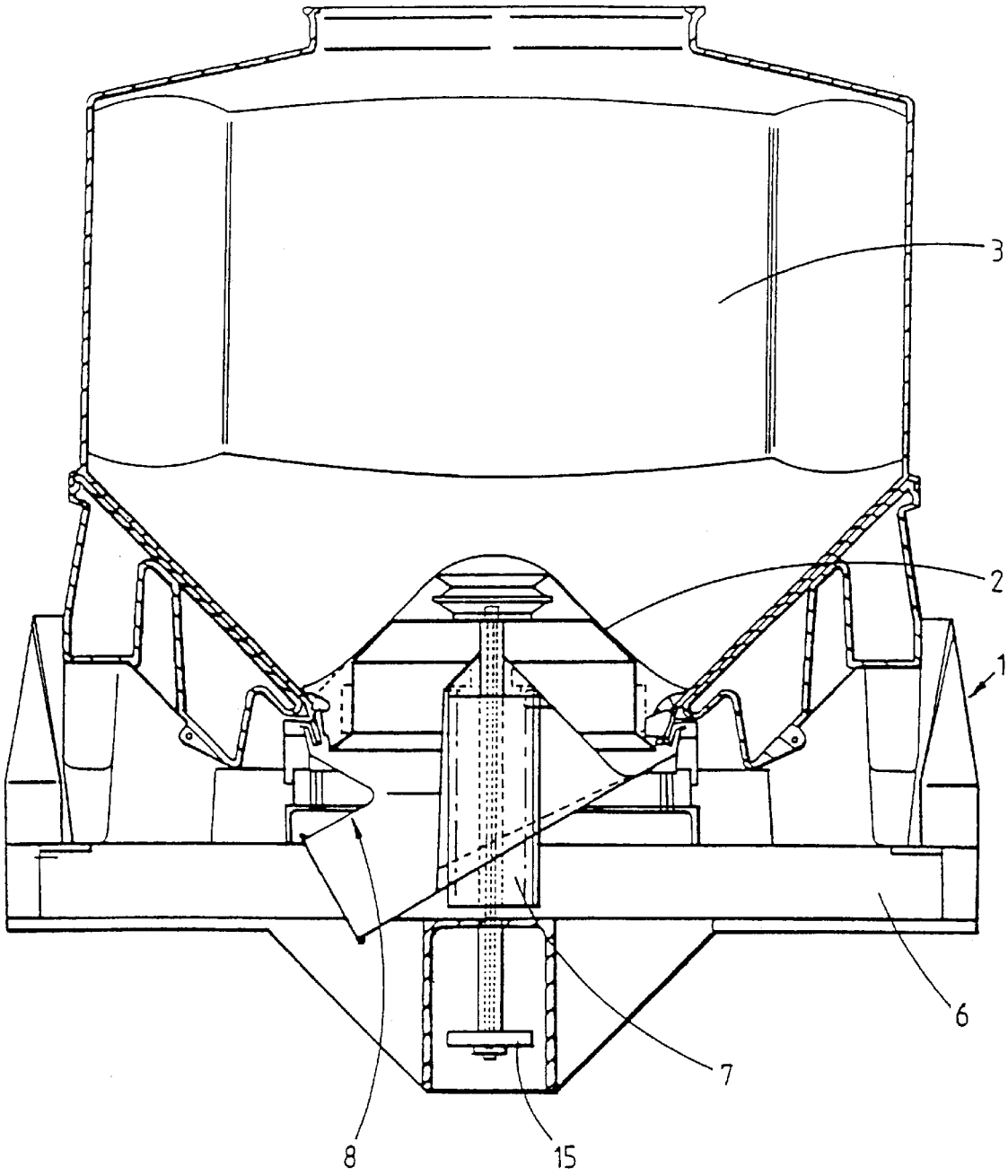
FIG. 4 is a side sectional view of the apparatus of FIGS. 1 and 2 in a closed position.
Figure 5:
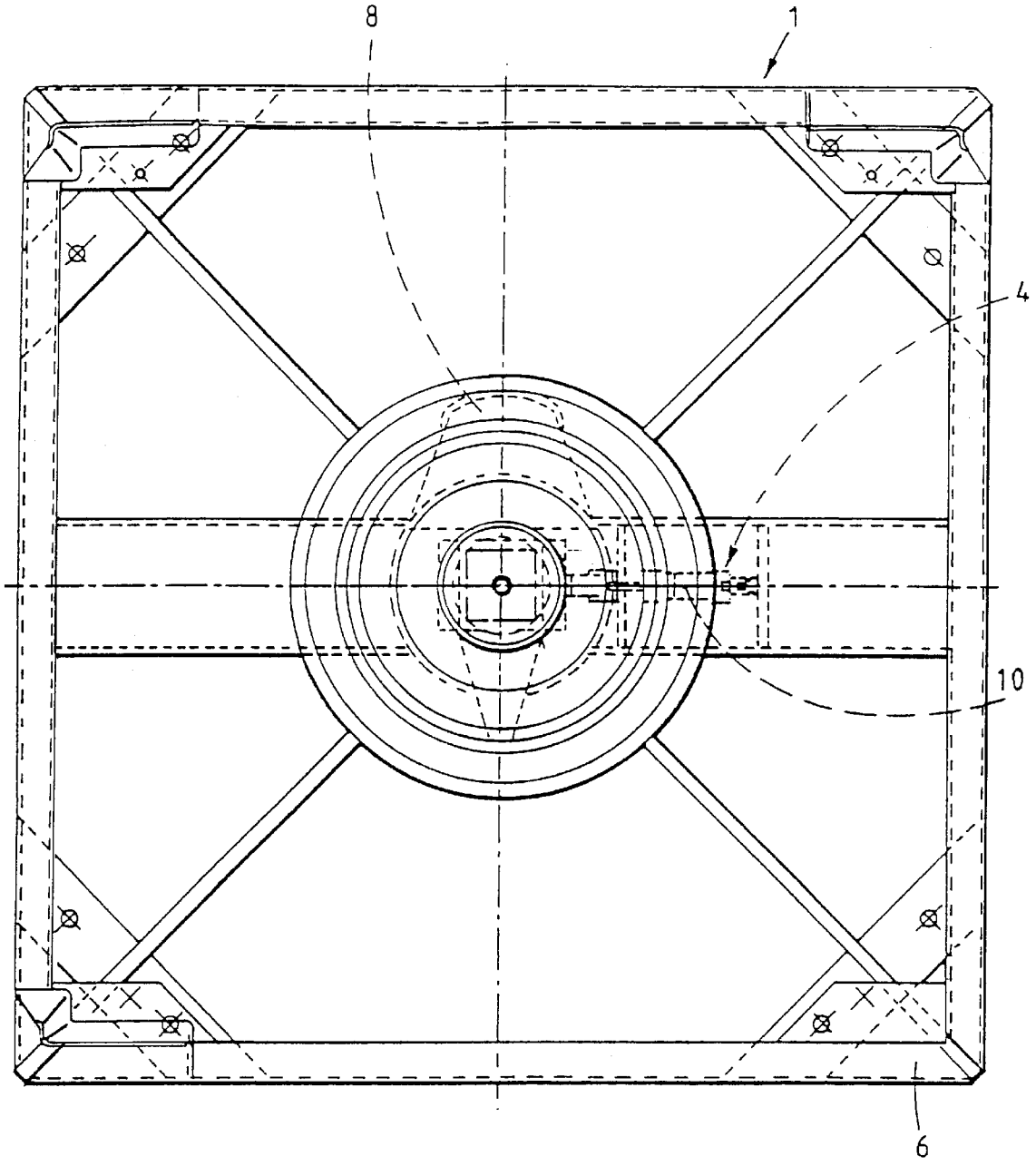
FIG. 5 is a plan view of the apparatus of FIG. 2.
Figure 6:
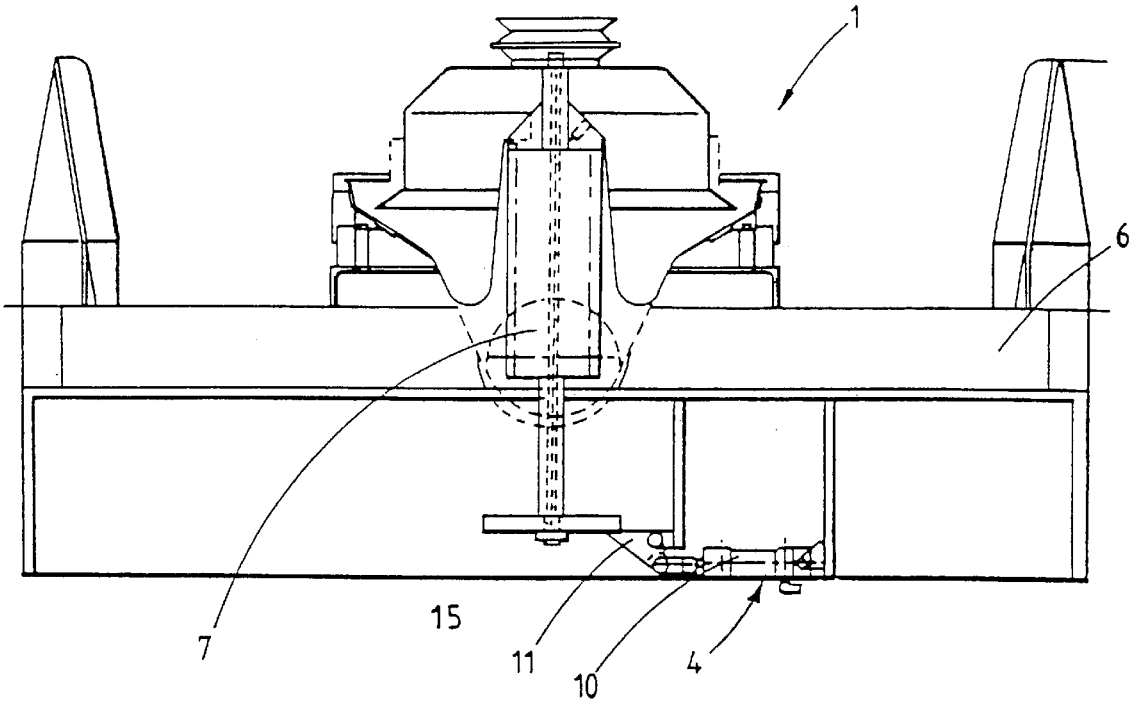
FIG. 6 is a transverse sectional view through the base part of a material storage container including apparatus according to the invention.
Figure 7:
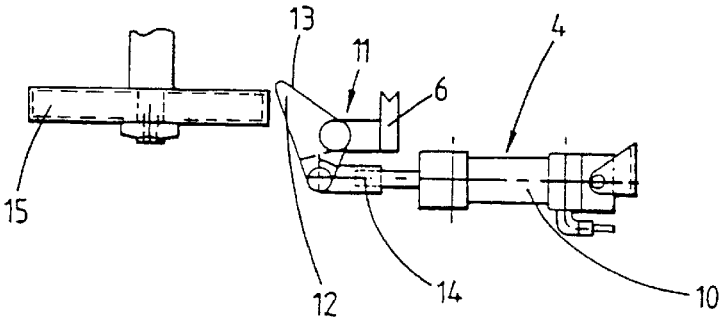
FIG. 7 is an enlarged view of apparatus according to the invention in a non-operative position.

The apparatus illustrated is that generally referred to as an Intermediate Bulk Container or IBC, which usually consists of a container 3 with an inlet 5 and an outlet (not shown). The container is mounted on a base part 6 on which it is supported. The base part 6 includes the apparatus 1 for operating a valve or closure 2 of the container, which in the illustrated embodiment is a generally conical device. Referring to FIGS. 3 and 4 of the device 2 generally comprises a cone-shaped stopper, the apex of which extends into the container 3. An edge seal or seals are provided around the periphery of the device 2 which sealingly engage with the mount of the aperture of the container to prevent material escaping when the device 2 or valve is in a closed position. The device 2 is moved from the open to the closed positions by apparatus which in the illustrated embodiment is in the form of lifting cylinder and 7 (with piston), situated outside (as viewed) of the device 2 in the base part 6.

The base part 6 is further provided with a chute 8 through which provide is delivered, which preferably is offset and angled away from the vertical by for example 30°, as viewed, in order to minimize damage to friable products such as tablets during their progress down the chute 8.

Referring to FIGS. 3 and 4, to deliver product from the container, the cylinder 7 is operated by any suitable control means, to extend the piston upwardly (as viewed) into the device 2, thereby raising it into the IBC. An annular gap 9 is thereby created through which product can flow from the container 3 and out through the chute 8. When a sufficient amount of product has been delivered, the cylinder 7 is again actuated by appropriate control means to lower the device 2 closing the annular gap 9 and preventing further product discharge.

As will be appreciated, in prior known discharge apparatus, when the device 2 is lowered back into the closed position, product for example in the form of tablets "bridges" and often becomes trapped between the device 2 and the rim of the aperture, and is crushed. Apparatus as shown herein embodying the invention overcomes this problem by providing regulating means 4 (FIGS. 2, 5, 6 and 7) which includes adjustment means 10. The adjustment means 10 is in the form of a cylinder device mounted on a part of the base 6, although any suitable device such as for example a bellows device could be used. The device of the adjustment means 10 is operatively connected with a movable stop means 11 in the form of a substantially triangular part having a tapered nose 12. The nose 12 has an upper (in use) surface 13. The stop means 11 is pivotably mounted both to an extension part of piston 14 of the cylinder 10 and a part of the base 6. As illustrated, the regulating means 4 is mounted so as to be cooperable with an inverted T extension part 15 which extends from the bottom (in use) of the cylinder 7 and is moved upwards and downwards with the cylinder 7.

In use, the container 3 is filled with product through the aperture 5 with the device 2 in the fully closed position illustrated in FIG. 4. The cylinder of the adjustment means 10 of the regulating means 4 is operated to extend the piston extension part 14, thus causing the tapered nose 12 of the stop means 11 to rise, away from the T-shaped extension 15, in a clockwise direction as illustrated. At this point, the T-shaped extension 15 is fully extended downwardly, as viewed.

When a batch of product is to be delivered from the IBC, a suitable receptacle is placed in communication with the chute 8 and the cylinder 7 is then operated to raise the device 2, as described above. Product then flows through the annular gap 9, down the chute 8 and into the receptacle. When delivery is complete, the adjustment means 10 is operated to withdraw the extension part 14 a preset amount. This has the effect of lowering the tapered nose 12 of the stop means 11 by the pivotal movement (counter-clockwise as illustrated) to a position below the T-shaped extension 15. The stop means 11 is thus locked into position. The cylinder 7 is then operated to lower the device 2, however the device cannot descend to the full sealing closed position, because the downward path of the T-shaped extension is blocked by the stop means 11, and in particular the upper surface 13 thereof. The rim of the device 2 is thus stopped short of the mouth of the aperture, by a distance which corresponds to the position of the stop means 11.

It is desirable to set the apparatus such that the annular gap which is left after the device is lowered is set to slightly larger than the average particle size of the product in the container so that the particles bridge and will not flow, nevertheless they will not be broken.

As will be appreciated, the size of the annular gap 9 is adjusted by adjusting the set position of the stop means 11.

As can be seen, the actuating mechanism having the cylinder 7 is underneath and outside the IBC which gives the additional ability to adjust the lift height of the cylinder 7 externally and also to provide a separately externally preset lift height. Although the IBC may be made of any suitable material, it is preferably of a moulded plastic construction. The central discharge hopper or chute 8 is also in the embodiment, made of plastic.

It is not necessary to provide any form of vibrator, such as is commonly used with apparatus of this kind, although for cohesive products the cylinder 7 can be oscillated to promote flow without harsh extreme vibration which can damage powder.

Thus, the apparatus illustrated in the drawings is capable of delivering friable products such as "green" capsules, free flowing powders or like particulate material and tablets, without damage occurring due to crushing between the closure and the container. This is because the apparatus has the chute 8 which has a very shallow inclined outlet as shown which allows the product to roll down or pass along the hopper walls gently and swirl around into the offset angled discharge pipe. The apparatus 1 is adjustable to cater for different grades and types of products and can be retro-fitted to existing material delivery systems if required.

It will be understood that the terms "crush", "crushing", "crushed" used herein cover spallinig, flaking chipping or otherwise providing physically reduced material.

What is claimed is:

1. Apparatus for operating a closure for an aperture of a material storage container, comprising:

first means for moving the closure between closed and open positions; and second means, operable independently of the first means, to stop movement of the closure toward the closed position so as to leave a gap between the closure and the aperture when the first means moves the closure toward the closed position.

2. Apparatus as defined in claim 1, wherein the second means comprises movable stop means adapted to abut a part of the apparatus when the closure is moved toward the closed position.

3. Apparatus as defined in claim 2, wherein the second means comprises adjustment means to adjust the position of the stop means relative to the closure.

4. Apparatus as defined in claim 2, wherein the second means comprises adjustment means operable to move the stop means from an operating to a non-operating position.

5. Apparatus as defined in claim 5, wherein the stop means is pivotably mounted for movement between operating and non-operating positions.

6. Apparatus as defined in claim 3, wherein the adjustment means comprises a cylinder.

7. Apparatus as defined in claim 2, wherein the stop means comprises a part which has a tapering nose, and wherein a surface of said nose is disposed to contact a part of the apparatus when the closure is moved toward the closed position.

8. Apparatus as defined in claim 1, including cylinder means for operating said closure.

9. Apparatus as defined in claim 8, wherein the second means is adapted to cooperate with a part of the cylinder means to set the position of said closure as it is moved toward the closed position.

10. Apparatus as defined in claim 9, wherein said cylinder part comprises an elongate extension, which is operable to move with the cylinder means when it is operated.

11. A material handling system comprising:

(i) a material storage container having an aperture (ii) a closure for said aperture; and (iii) apparatus for operating said closure, as defined in claim 1.

12. A material handling system, as defined in claim 11, wherein the apparatus is disposed outside the container and closure.

13. A method of transferring a flowable material from a material storage container having a discharge aperture and a closure for the aperture, comprising:

(i) providing a first apparatus to move the closure relative to the aperture between closed and open positions;

(ii) providing a second apparatus, operable independently of the first apparatus, regulating the position of the closure relative to the aperture;

(iii) using the first apparatus to move the closure to the open position to allow material to pass out of the container via the aperture;

(iv) using the first apparatus to move the closure toward a closed position; and (v) using the second apparatus to stop movement of the closure toward the closed position so as to leave a gap between the closure and the aperture when the first apparatus moves the closure toward the closed position, such that material trapped between the closure and the container is not crushed.

14. A method of transferring a flowable material from a material storage container having a discharge aperture and a closure for the aperture, comprising:

(i) providing a first apparatus to move the closure relative to the aperture between closed and open positions;

(ii) providing a second apparatus, operable independently of the first apparatus, regulating the position of the closure relative to the aperture;

(iii) using the first apparatus to move the closure to the open position to allow material to pass our of the container via the aperture;

(iv) using the first apparatus to move the closure toward a closed position; and (v) using the second apparatus to regulate the position of the closure relative to the aperture so as to leave a gap between the closure and the aperture, such that material trapped between the closure and the container is not crushed, wherein the second apparatus is preset to leave a predetermined gap between the closure and the container.

* * * * *